US007661609B2

(12) United States Patent
Dexter et al.

(10) Patent No.: US 7,661,609 B2
(45) Date of Patent: Feb. 16, 2010

(54) PRESSURE WASHER WITH SOFT START WASHER WAND

(75) Inventors: Shane Dexter, Humboldt, TN (US); Dinesh Koka, Memphis, TN (US)

(73) Assignee: Black & Decker Inc., Newark, DE (US)

( * ) Notice: Subject to any disclaimer, the term of this patent is extended or adjusted under 35 U.S.C. 154(b) by 393 days.

(21) Appl. No.: 11/518,602

(22) Filed: Sep. 8, 2006

(65) Prior Publication Data

US 2007/0051834 A1 Mar. 8, 2007

Related U.S. Application Data

(60) Provisional application No. 60/715,068, filed on Sep. 8, 2005.

(51) Int. Cl.

| | |
|---|---|
| ***F23D 11/46*** | (2006.01) |
| *B05D 9/01* | (2006.01) |
| *B05B 9/04* | (2006.01) |
| *B05B 1/30* | (2006.01) |
| *A62C 31/02* | (2006.01) |

(52) U.S. Cl. ..... 239/527; 239/332; 239/526; 239/581.1; 239/528; 239/447; 239/443; 239/445; 137/625.28; 137/625.4; 137/625.39; 137/627.5

(58) Field of Classification Search ..... 239/332, 239/526, 527, 581.1, 528, 391, 436, 443, 239/444, 445, 446; 137/625.28, 625.4, 625.39, 137/627.5

See application file for complete search history.

(56) References Cited

U.S. PATENT DOCUMENTS

| | | | | | |
|---|---|---|---|---|---|
| 1,636,859 | A * | 7/1927 | Dempler | 137/596.18 |
| 2,754,153 | A * | 7/1956 | Barthod | 239/416.2 |
| 3,049,303 | A * | 8/1962 | Kocher | 239/312 |
| 3,672,575 | A * | 6/1972 | Hinrichs | 239/445 |
| 3,684,187 | A * | 8/1972 | Etter | 239/414 |
| 3,698,641 | A * | 10/1972 | Lonardo | 239/434 |
| 3,770,201 | A * | 11/1973 | Sanders | 239/135 |
| 3,840,184 | A * | 10/1974 | Spivey | 239/415 |
| 4,214,630 | A * | 7/1980 | Gagliardo | 169/18 |
| 4,413,785 | A * | 11/1983 | Engelbert et al. | 239/443 |
| 4,541,568 | A * | 9/1985 | Lichfield | 239/441 |
| 4,749,128 | A * | 6/1988 | Smith | 239/414 |
| 4,821,961 | A * | 4/1989 | Shook | 239/253 |
| 5,024,382 | A * | 6/1991 | Shook et al. | 239/11 |
| 5,064,123 | A * | 11/1991 | Aiello et al. | 239/706 |
| 5,297,733 | A * | 3/1994 | Burks et al. | 239/85 |
| 5,421,520 | A * | 6/1995 | Simonette et al. | 239/525 |
| 5,525,046 | A * | 6/1996 | Hartmann | 417/300 |
| 5,667,141 | A * | 9/1997 | Suttner | 239/332 |
| 6,260,772 | B1 * | 7/2001 | Hennemann et al. | 239/310 |

(Continued)

*Primary Examiner*—Dinh Q Nguyen
*Assistant Examiner*—Steven Cernoch
(74) *Attorney, Agent, or Firm*—Harness, Dickey & Pierce, P.L.C.

(57) ABSTRACT

A pressure washer wand having first and second valves that can be opened in a predetermined or user-adjustable manner through movement of a trigger. In one form, the first and second valves are opened sequentially in response to movement of a trigger to transition from a no-flow condition to a relatively low pressure flow and thereafter to a relatively high pressure flow. In another form, the sequencing of the valves can be changed such that only the first valve, which provides a relatively low pressure flow, is opened in response to movement of the trigger. A pressure washing system having the pressure washer wand is also provided.

22 Claims, 6 Drawing Sheets

U.S. PATENT DOCUMENTS 6,378,789 B1 * 4/2002 Seaman et al. ..... 239/443
2003/0052193 A1 * 3/2003 Shanklin et al. ..... 239/318
2005/0121542 A1 * 6/2005 Su Lim ..... 239/525

* cited by examiner

PRESSURE WASHER WITH SOFT START WASHER WAND

CROSS-REFERENCE TO RELATED APPLICATIONS

This application claims the benefit of U.S. Provisional Patent Application Ser. No. 60/715,068 entitled "Soft Start Pressure Washer Gun" filed Sep. 8, 2005, the disclosure of which is hereby incorporated by reference as if fully set forth in detail herein.

INTRODUCTION

The present disclosure generally relates to pressure washers and more particularly to a pressure washer having a pressure washer wand with a soft start operational mode.

Pressure washer wands or guns typically employ a single normally closed valve to control the dispensing of fluid from the wand. In such arrangements, the wand can be operated in two conditions: a no-flow condition, wherein the valve is closed, and a high pressure flow condition, wherein the valve is opened. The transition between the two conditions can be very sudden and can result in recoil that can be uncomfortable to the user. Accordingly, it would be desirable to provide a pressure washer having a wand with a soft start mode that permits the wand to transition from a no-flow condition to a flow of relatively low pressure fluid and thereafter to a flow of relatively high pressure fluid to provide the user with a "soft" start as the user moves the trigger to a position that is associated with maximum high-pressure flow.

SUMMARY

In one form, the present teachings provide a pressure washer wand having a housing, a valve, a first outlet, a second outlet and a trigger. The housing has a pistol-grip handle and a trigger guard. The valve assembly is housed in the housing and includes a first valve and a second valve. Each of the first and second valves includes a valve member that is movable between a closed position and an open position. Each valve member is biased toward the closed position. The first outlet is in fluid communication with the first valve and the second outlet is in fluid communication with the second valve. The trigger is coupled to the housing between the pistol grip handle and the trigger guard. The trigger is movable between a first position and a second position and has a first cam and a second cam. The first and second cams are configured to move the valve members of the first and second valves, respectfully, so that movement of the trigger from the first position to the second position opens a first fluid communication pathway from the first valve to the first outlet when the trigger is positioned in a first intermediate position between the first and second positions, and opens a second fluid communication pathway from the second valve to the second outlet when the trigger is positioned in a second intermediate position between the first intermediate position and the second position.

Further areas of applicability will become apparent from the description provided herein. It should be understood that the description and specific examples are intended for purposes of illustration only and are not intended to limit the scope of the present disclosure.

BRIEF DESCRIPTION OF THE DRAWINGS

The drawings described herein are for illustration purposes only and are not intended to limit the scope of the present disclosure in any way.

DETAILED DESCRIPTION OF THE VARIOUS EMBODIMENTS

Figure 1:
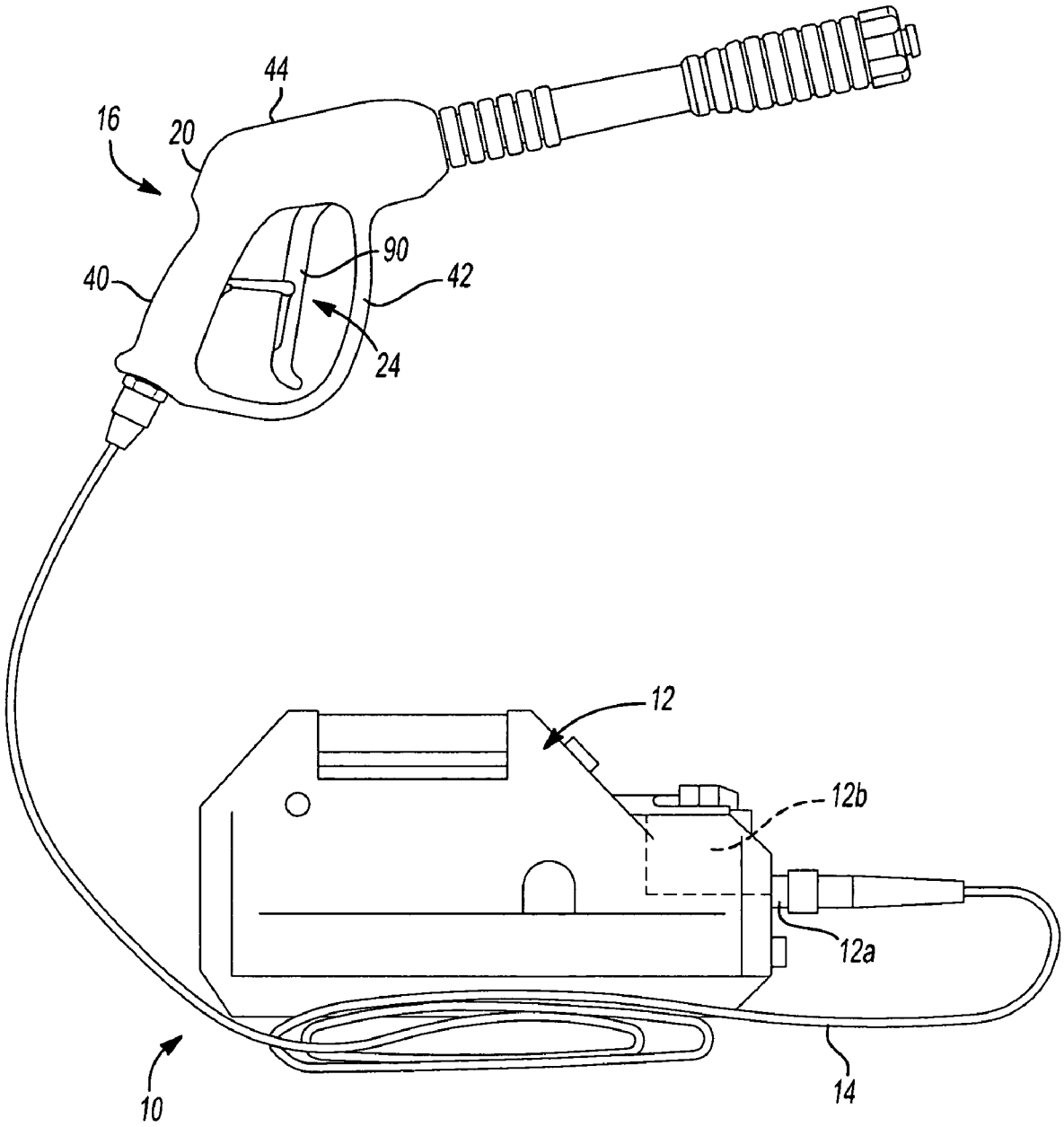
FIG. 1 is a side elevation view of a pressure washer system having a wand constructed in accordance with the teachings of the present disclosure.

With reference to FIG. 1 of the drawings, a pressure washer system constructed in accordance with the teachings of the present invention is generally indicated by reference numeral 10. The pressure washer system 10 can include a pump 12, a high pressure hose 14 and a wand 16. The pump 12 and the high pressure hose 14 can be constructed in any appropriate manner. For example, the pump 12 can include an electric motor and an axial piston pump having a wobble plate that is driven by the electric motor. Moreover, the pump 12 can be constructed in the manner described in U.S. Pat. No. 6,892,957 entitled "Pressure Washer With Improved Mobility", the disclosure of which is hereby incorporated by reference as if fully set forth in detail herein. The hose 14 can be coupled to an outlet 12*a* of the pump 12.

Figure 2:
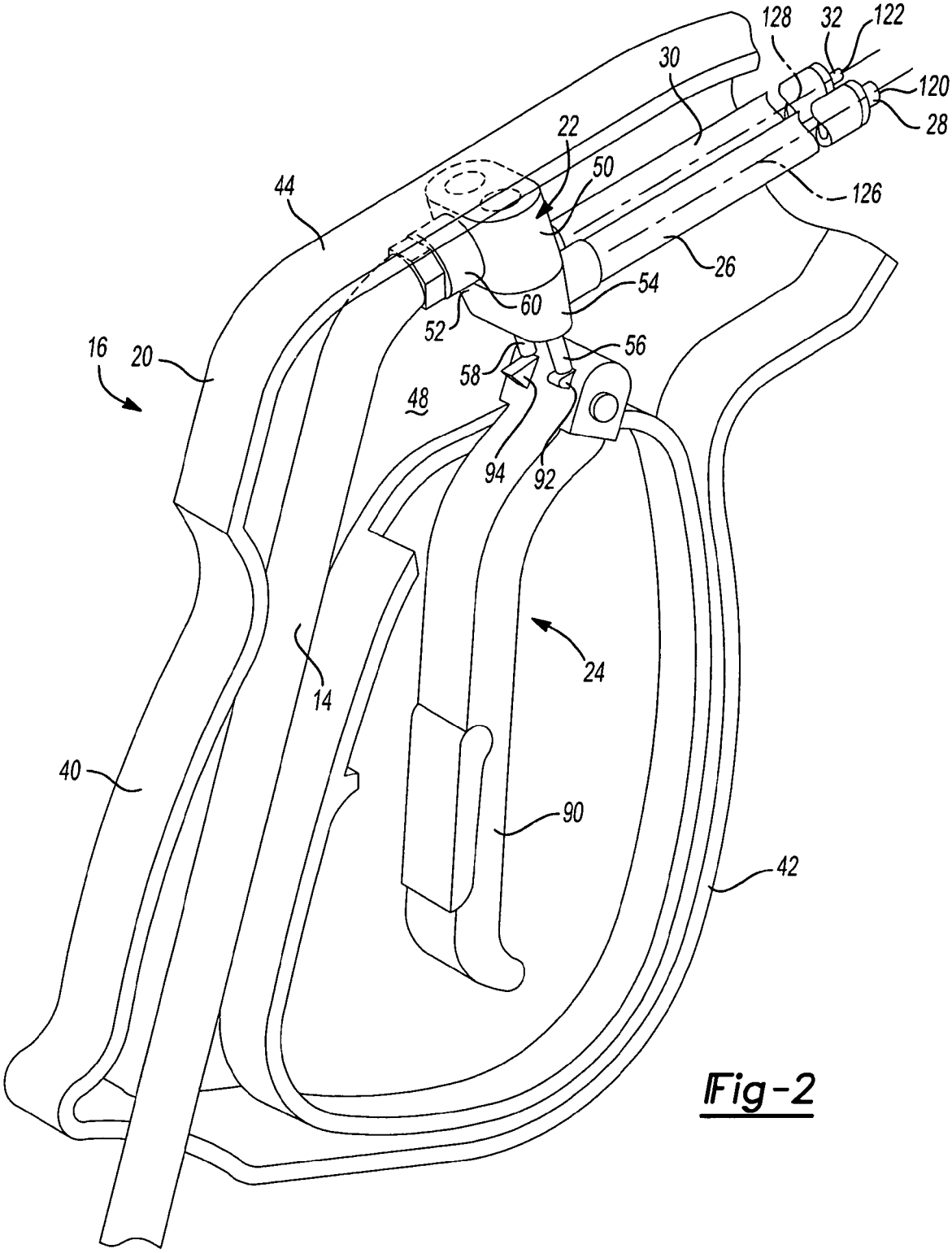
FIG. 2 is a partially broken-away perspective view of the wand of FIG. 1.
Figure 3:
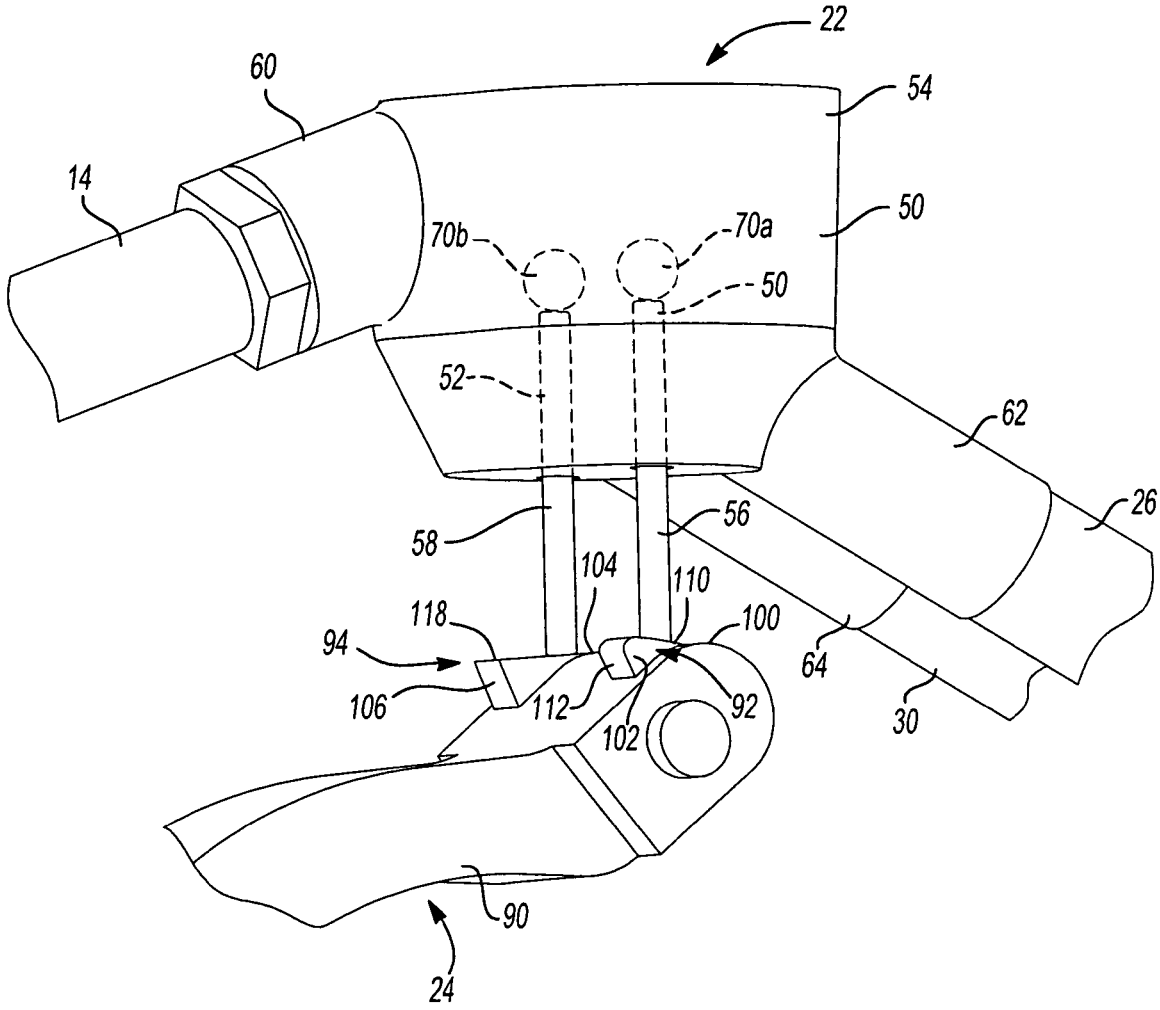
FIG. 3 is a perspective view of a portion of the wand of FIG. 1 illustrating the valve assembly and trigger lever in greater detail.

With reference to FIGS. 2 and 3, the wand 14 can include a housing 20, a valve assembly 22, a trigger lever 24, a first conduit 26, a first nozzle 28, a second conduit 30 and a second nozzle 32. The housing 20 can include a pistol-grip handle 40 and a trigger guard 42. The housing 20 can employ a clamshell construction having a pair of clamshells 44 that cooperate to form an interior cavity 48 that can house the valve assembly 22.

The valve assembly 22 can include a first valve 50, which can be coupled in fluid communication to the first conduit 26, and a second valve 52 that can be coupled in fluid communication with the second conduit 30. In the particular example provided the first and second valves 50 and 52 share a common valve body 54 into which first and second valve elements 56 and 58, respectively, are housed.

Figure 4:
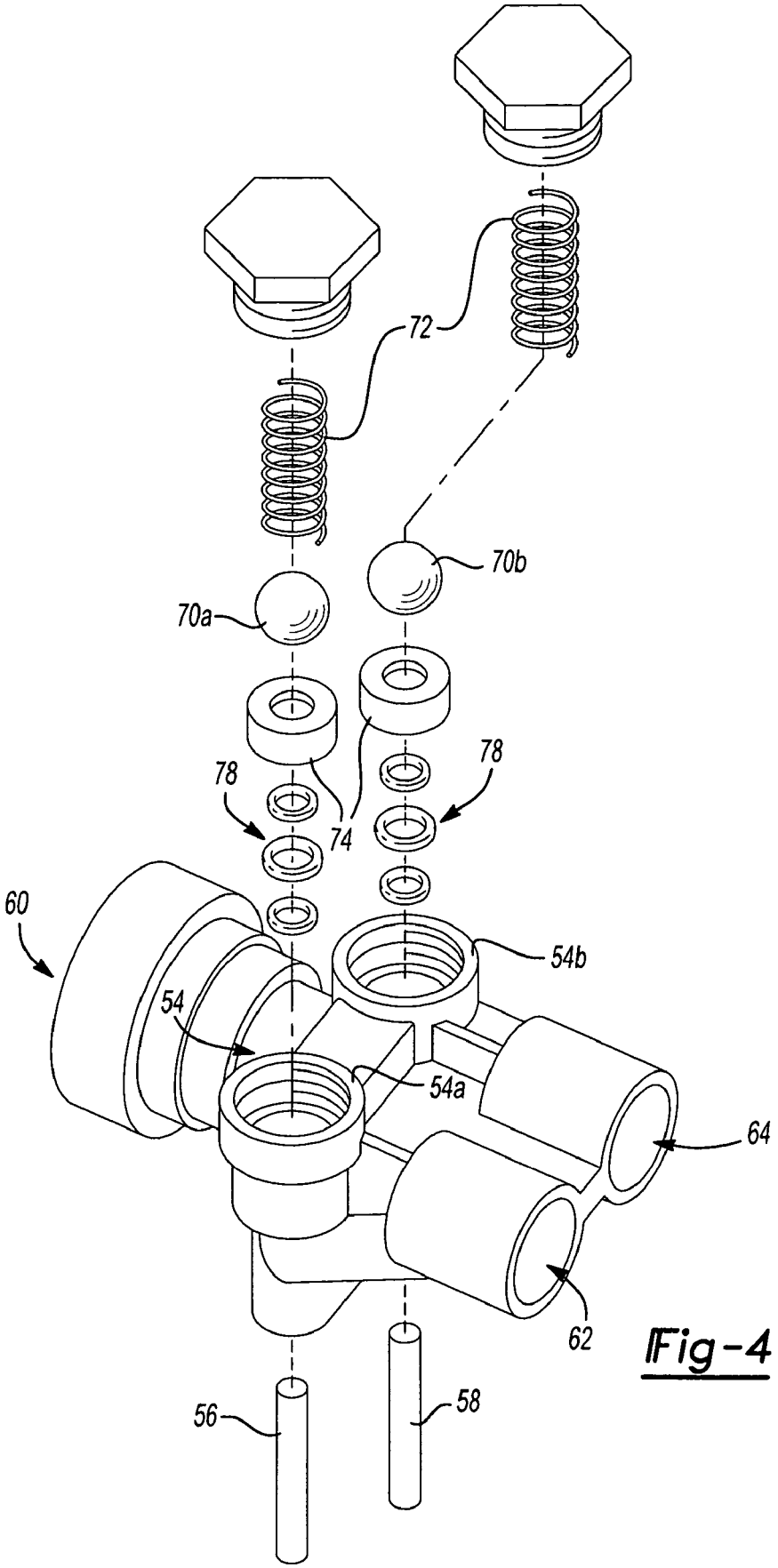
FIG. 4 is an exploded perspective view of a portion of the wand.

With additional reference to FIG. 4, the valve body 54 can include an inlet 60, which can be coupled in fluid connection to the hose 14, a first valve outlet 62, which can be coupled in fluid connection to the first conduit 26, and a second valve outlet 64, which can be coupled in fluid connection to the second conduit 30. A first valve body portion 54*a* of the valve body 54 can be configured to house the first valve element 56 and a second valve body portion 54*b* can be configured to house the second valve element 58.

In the particular example provided, the first and second valves 50 and 52 are identical in their construction and as such, a discussion of the first valve 50 will suffice for both. A first valve member 70*a* can be biased by a spring 72 against a seat member 74 to sealingly close a passageway (not shown) in the first valve body portion 54*a* between the inlet 60 and the first valve outlet 62. The first valve element 56 can be received in the first valve body portion 54*a* and can be located in-line with the first valve member 70*a*. Although the first valve member 70*a* and the first valve element 56 are illustrated as being discrete components, those of ordinary skill in the art will appreciate that the first valve member 70*a* and the first valve element 56 could be integrally formed. A seal arrangement 78 can be employed to seal the first valve body portion 54*a* to the first valve element 56 in a manner that permits the first valve element 56 to move relative to the first valve body portion 54*a*. The spring 72 can bias the first valve member 70*a* against the seat member 74 to sealingly close the passageway between the inlet 60 and the first valve outlet 62. Movement of the first valve element 56 into the valve body 54 by a distance that is sufficient to un-seat the first valve member 70*a* from the seat member 74 opens the passageway between the inlet 60 and the first valve outlet 62 to permit fluid to flow through the first valve 50.

It will be appreciated from this disclosure that the first valve member 70*a* is biased into a normally closed position to inhibit fluid flow through the first valve body portion 54*a* but can be moved to an opened position to permit fluid to flow from the first valve body portion 54*a* through the first conduit 26 and to the first nozzle 28. Similarly, it will be appreciated from this disclosure that the second valve member 70*b* is biased into a normally closed position to inhibit fluid flow through a second valve body portion 54*b* but can be moved to an opened position to permit fluid to flow from the second valve body 54 through the second conduit 30 and to the second nozzle 32.

The trigger lever 24 can include a trigger 90, a first cam 92 and a second cam 94. The trigger 90 can be pivotally coupled to the housing 20 and can be moved between a first position and a second position. Although the trigger 90 is directly pivotally coupled to the housing 20 in the example provided, it will be appreciated that as used herein, "coupled to the housing" should be broadly interpreted to mean that the trigger 90 can be pivotally coupled to any structure that is connected to the housing 20, including the first valve 50 and/or the second valve 52.

The first cam 92 can be fixedly coupled to a first side of the trigger lever 24 and the second cam 94 can be fixedly coupled to a second side of the trigger lever 24. In the particular example provided, the first and second cams 92 and 94 are integrally formed with the trigger lever 24. The first and second cams 92 and 94 can be sized, shaped and positioned to provide the wand 14 with a soft start function as will be described in further detail, below. In the particular example provided, the first cam 92 includes a first base portion 100 and a first cam lobe 102, while the second cam 94 includes a second base portion 104 and a second cam lobe 106. The first and second base portions 100 and 104 can be sized such that the first and second valve elements 56 and 58, respectively, which ride on the first and second cams 92 and 94, respectively, are not moved into the valve body 54 to move the first and second valve members 70*a* and 70*b* from the closed position. Stated another way, the first and second base portions 100 and 104 are sized to permit the first and second valve members 70*a* and 70*b*, respectively, to be maintained in (i.e., biased into) the closed position. The first cam lobe 102 can include a first ramp member 110 and a second ramp member 112. The first ramp member 110 can taper radially outwardly from the first base portion 100 between the first base portion 100 and the second ramp member 112. The second ramp member 112 can taper radially inwardly toward the first base portion 100 between the first ramp member 110 and the first base portion 100. The second cam lobe 106 can include a third ramp member 118 that extends radially outwardly of the second base portion 104.

The first and second cam lobes 102 and 106 can be timed in any desired manner to control the opening and closing of the first and second valve members 70*a* and 70*b*, respectively. In the particular example provided, the first cam lobe 102 is positioned such that the first valve element 56 is transitioning from the first ramp member 110 to the second ramp member 112 when the second valve element 58 is being translated into the valve body 54 by the third ramp member 118 to open the second valve member 70*b*.

A first end of the first conduit 26 can be coupled in fluid connection to the first valve outlet 62 of the first valve 50, while a second, distal end of the first conduit 26 can be coupled in fluid connection to the first nozzle 28. The first nozzle 28 can have a first outlet 120 through which fluid may be dispensed. The first outlet 120 can have a diameter that can be equal to an inner diameter of the first conduit 26 (i.e., the first nozzle 28 can be the distal end of the first conduit 26). In the particular example provided, however, the first nozzle 28 is a discrete nozzle that is fixedly coupled to the distal end of the first conduit 26.

Similarly, a first end of the second conduit 30 can be coupled in fluid connection to the second valve outlet 64 of the second valve 52, while a second, distal end of the second conduit 30 can be coupled in fluid connection to the second nozzle 32. The second nozzle 32 can have a second outlet 122 that can have a diameter that can be smaller in diameter than the inner diameter of the second conduit 30. The second outlet 122 can be relatively smaller than the first outlet 120. The first and second conduits 26 and 30 can be discrete structures that can be disposed along parallel axes 126 and 128, respectively.

With additional reference to FIG. 1, the pump 12 can be operated to supply high pressure fluid (e.g., water) through the hose 14 to the wand 16. More specifically, high pressure fluid transmitted through the hose 14 is communicated to the first and second valves 50 and 52. When the trigger lever 24 is positioned in the first position, the first and second valve elements 56 and 58 can be positioned on the first and second base portions 100 and 104, respectively, of the first and second cams 92 and 94. Accordingly, the first and second valve members 70*a* and 70*b* are maintained in the closed position and fluid is not transmitted through the first valve 50 or the second valve 52.

When the trigger lever 24 is positioned to a first intermediate position between the first and second positions, the first valve element 56 can be positioned on the first ramp member 110 and the second valve element 58 can be positioned on the second base portion 104. Accordingly, the first valve member 70*a* is maintained in an open position so that fluid is permitted to flow through the first valve 50 through the first conduit 26 and out of the first nozzle 28, but the second valve member 70*b* is maintained in the closed position and fluid is not permitted to flow through the second valve 52. As the flow paths through the first conduit 26 and the first nozzle 28 are relatively large in cross-sectional area, fluid can be dispensed from the first nozzle 28 with relatively little backpressure. It will be appreciated in the particular example provided that the first valve member 70*a* can be opened to a maximum amount by further rotation of the trigger lever 24 to a point at which the first valve element 56 is located on the transition point between the first and second ramp members 110 and 112.

When the trigger lever 24 is positioned to a second intermediate position between the first intermediate position and the second position, the first valve element 56 can be positioned on the second ramp member 112 and the second valve element 58 can be positioned on the third ramp member 118. Accordingly, the first and second valve members 70*a* and 70*b* can be maintained in the open position so that fluid is permitted to flow through the first valve 50, the first conduit 26 and out of the first nozzle 28, as well as through the second valve 52, the second conduit 30 and out the second nozzle 32. As fluid is dispensed out of both the first and second nozzles 28 and 32, relatively little backpressure is developed and consequently, the user experiences relatively little recoil when the second valve 52 is opened.

When the trigger lever is positioned to the second position, the first valve element 56 can be positioned on the first base portion 100 and the second valve element 58 can be positioned on the third ramp member 118 so as to open the second valve element 58 by a maximum amount. Accordingly, the first valve member 70*a* is maintained in the closed position so that fluid is not permitted to flow through the first valve 50, and the second valve member 70*b* is maintained in the open position so that fluid flows out of the second valve 52 through the second conduit 30 and out the second nozzle 32. It will be appreciated that due to the shape of the second ramp member 112, the first valve 50 is closed as the trigger lever 24 is pivoted from the second intermediate position to the second position. It will also be appreciated that the closing of the first valve 50 can be as gradual or sudden as desired and that the timing of the closing of the first valve 50 and/or opening of the second valve 52 is dictated by the degree to which the second and third ramp members 112 and 118, respectively, are sloped.

Figure 5:
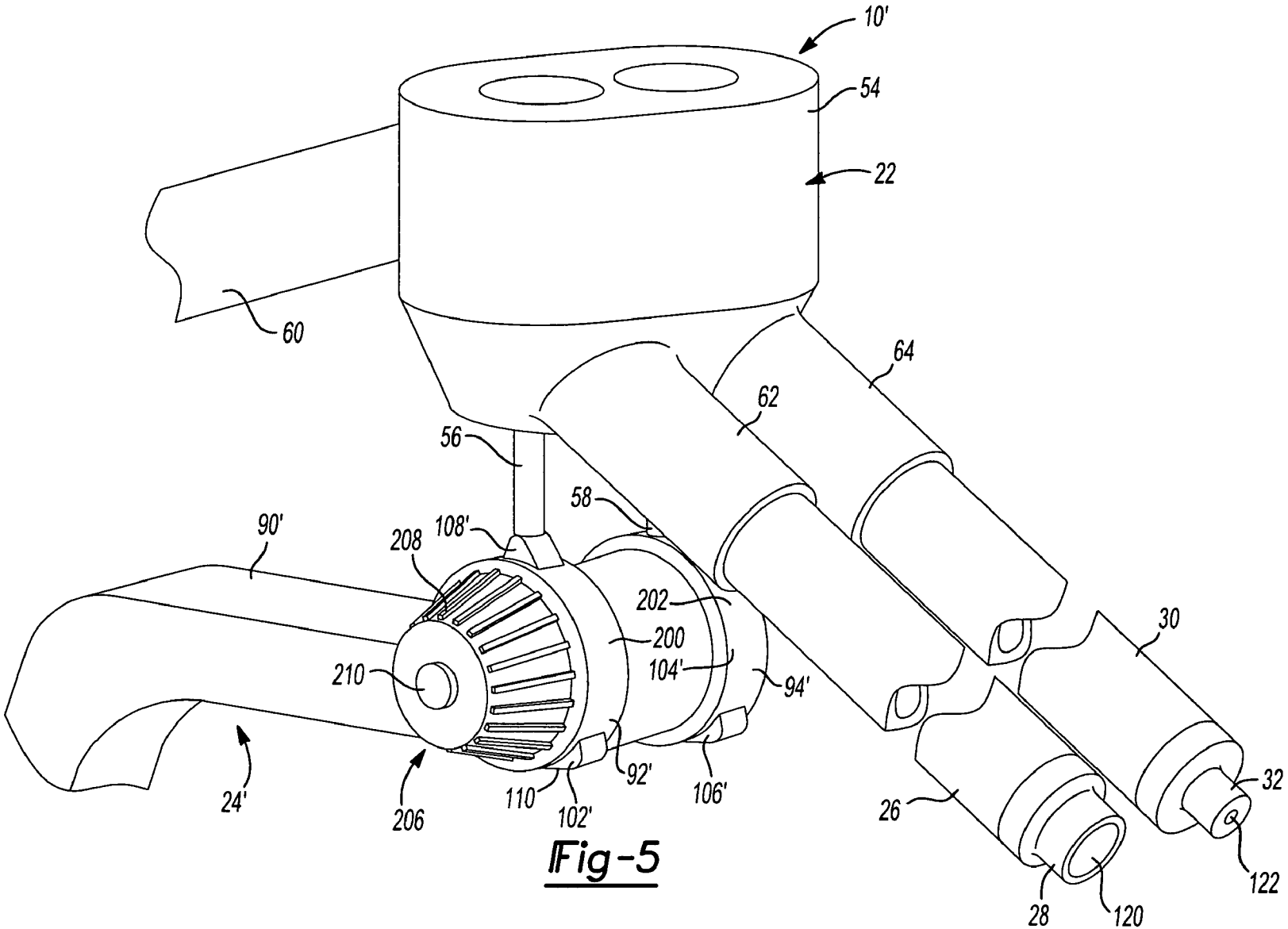
FIG. 5 is a perspective view of a portion of another wand constructed in accordance with the teachings of the present disclosure.
Figure 6:
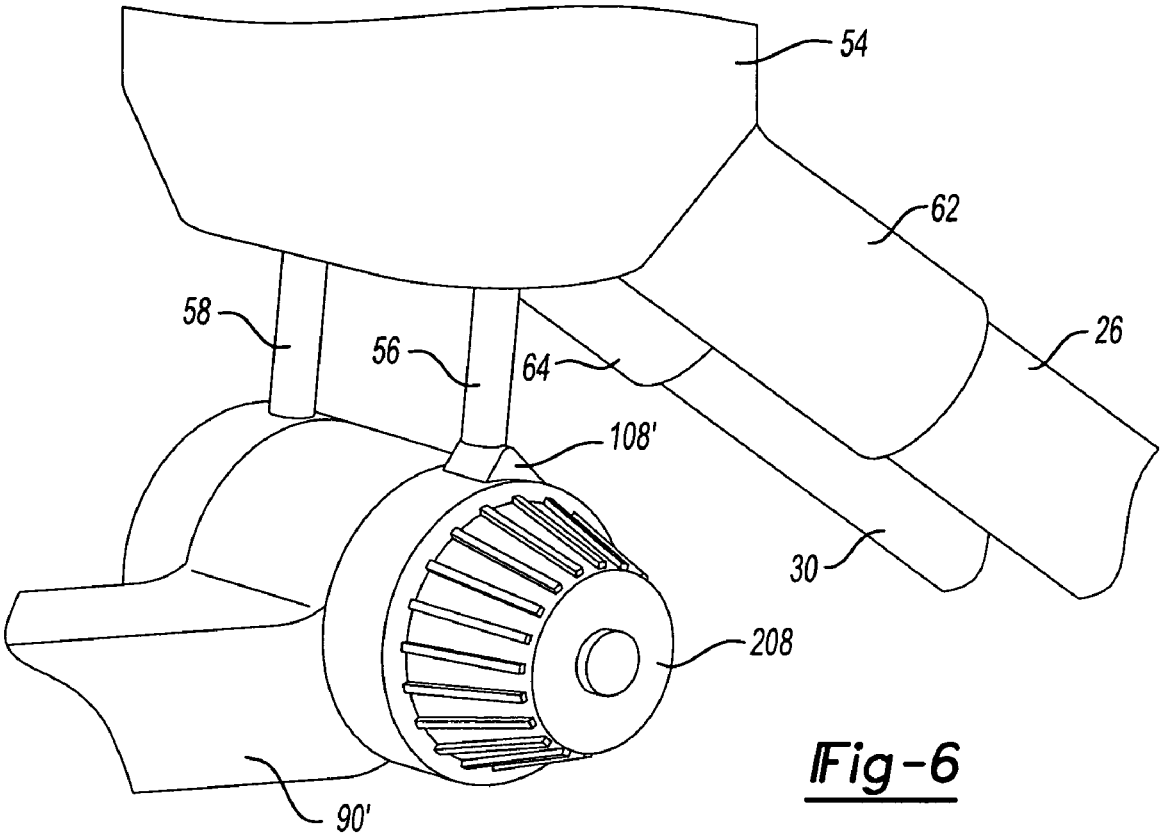
FIGS. 6 and 7 are perspective views of a portion of the wand of FIG. 5 illustrating the trigger lever and the valve assembly in more detail.
Figure 7:
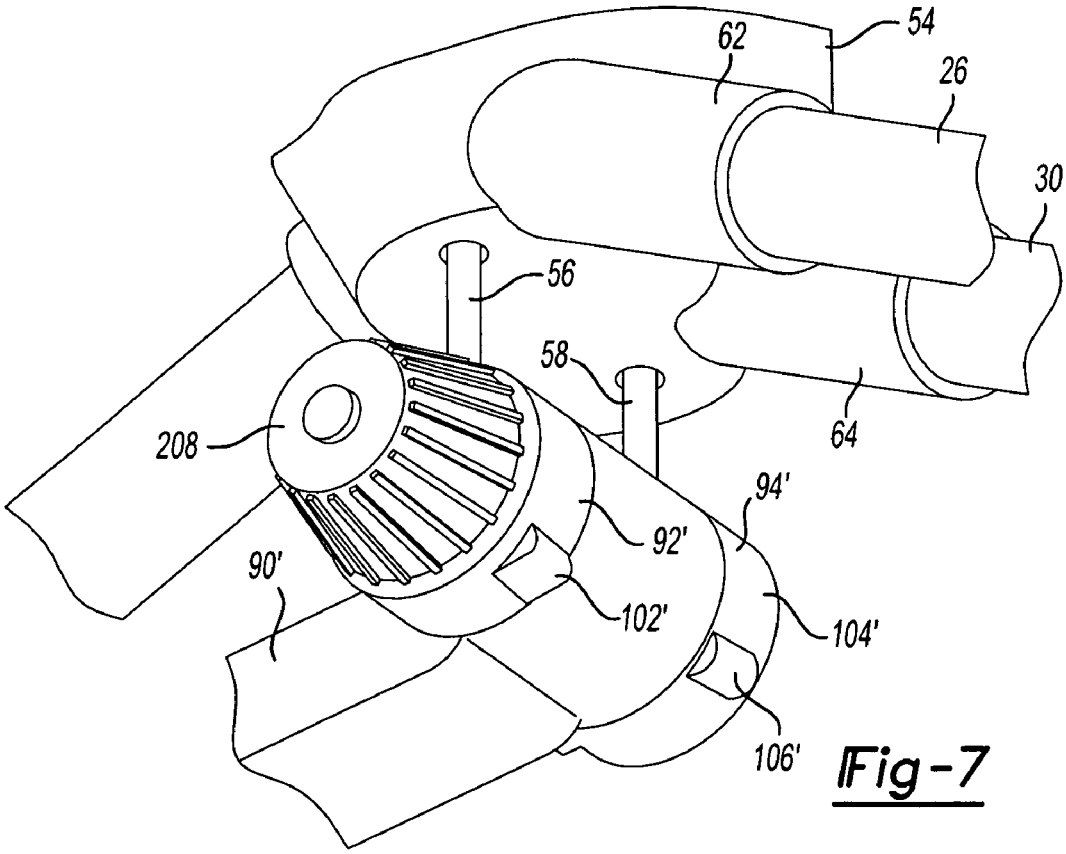

While the pressure washer system 10 has been described as including a wand 16 having a trigger 90 with first and second cams 92 and 94 that are fixedly coupled to a trigger lever 24, those skilled in the art will appreciate that the disclosure, in its broader aspects, need not be so limited. For example, the first and second cams 92' and 94' can be adjustably coupled to the trigger lever 24' as shown in FIGS. 5 through 7. In the example illustrated, the first cam 92' is formed on a first drum 200 that can be disposed on a first side of the trigger 90' and the second cam 94' is formed on a second drum 202 that can be disposed on a second side of the trigger 90'. In the particular example provided, the first and second drums 200 and 202 are rotatably coupled to one another and a locking mechanism 206 is employed to selectively lock the first and second drums 200 and 202 to the trigger 90'. The locking mechanism 206 could include, for example, a threaded nut 208 that is threadably engaged to a pivot pin 210 that extends through the first and second drums 200 and 202 and the trigger 90'; the pivot pin 210 can be employed to rotatably mount the trigger 90' to the valve body 54 or the housing 20 (FIG. 2). Tightening of the threaded nut 208 can apply a clamping force to the first drum 200 to cause an end of the first drum 200 to engage a side of the trigger 90' to thereby inhibit relative rotation between the first drum 200 and the trigger 90'. As the first drum 200 and the second drum 202 are rotatably coupled to one another, rotation of the second drum 202 relative to the trigger 90' is inhibited when the first drum 200 is engaged to the trigger 90'.

The first and second drums 200 and 202 can be positioned in a first setting that associates the first and second cam lobes 102' and 106', respectively, to the trigger 90' in a manner that is similar to the manner in which the first and second cams 92 and 94 (FIG. 2) are associated to the trigger 90 (FIG. 2) to provide a soft start mode of operation.

The first and second drums 200 and 202 can also be positioned in a second setting wherein the first valve element 56 is disposed on a third cam lobe 108' and the second valve element 58 is disposed on the second base portion 104' when the trigger 90' is in the second position. The third cam lobe 108' can include one or more tapered ramp members and in the particular example provided, has a geometry and shape that is generally identical to the second cam lobe 106'. Accordingly, it will be appreciated that fluid may be selectively dispensed through only the first valve 50' (and out the first nozzle 28) when the first and second drums 200 and 202 are positioned in the second setting.

Alternatively, the third cam lobe 108' may be omitted in which case the second setting can comprise the positioning of the first and second drums 200 and 202 such that the first valve element 56 is disposed on the first ramp member 110 and the second valve element 58 is disposed on the second base portion 104' when the trigger 90' is in the second position.

It will be appreciated that the wand 10' could be coupled to the pump 12 (FIG. 1) and that the pump 12 (FIG. 1) could include an auxiliary tank 12*b* (FIG. 1) for dispensing an additive from the auxiliary tank 12*b* (FIG. 1) to the flow of fluid that is discharged through the outlet 12*a* (FIG. 1). Those of ordinary skill in the art will appreciate that such dispensing systems typically operate when a difference between the pressure of the fluid flowing out the outlet 12*a* (FIG. 1) and the pressure within the auxiliary tank 12*b* (FIG. 1), which is typically atmospheric pressure, is not greater than a predetermined differential and that such condition can be achieved when fluid is dispensed through a wand having a relatively large nozzle that outputs fluid at a relatively low pressure. In contrast to the known systems, which require that the user remove the high pressure nozzle from the wand and attach a low pressure nozzle to thereby activate the dispensing of an additive from an auxiliary tank, a user need only place the first and second drums 200 and 202 in the second setting to activate the dispensing of an additive from the auxiliary tank 12*b* (FIG. 1). Accordingly, it will be appreciated that the user may control the dispensing of an additive, such as a soap, from the auxiliary tank 12*b* (FIG. 1) through a control means that is located on the wand 10'. Consequently, a user may activate the dispensing of an additive from the auxiliary tank 12*b* (FIG. 1) and thereafter de-activate the dispensing of the additive from the auxiliary tank 12*b* (FIG. 1) without attaching or detaching nozzles but rather merely by rotating the first and second drums 200 and 202 into and out of the second setting, respectively.

It will also be appreciated that the second drum 202 could include a fourth cam lobe (not shown) on the second cam 94' that permits only the second valve element 58 to be moved when the trigger 90' is moved from the first position to the second position. In this regard, those of ordinary skill in the art will understand from this disclosure that the first and second cams 92' and 94' could be configured with multiple cam lobes that permit the first and second valves 52 and 54 to be selectively opened and/or selectively closed in a plurality of predetermined arrangements. The construction of the first and second cams 92' and 94' can be shaped and/or sized to open the first and second valves 52 and 54, respectively, by a desired amount, as well as circumferentially spaced relative to one another to time the opening and/or closing of the first and second valves 52 and 54, respectively, in a desired manner. It will be further appreciated that a third cam (not shown) may be coupled to the first cam 92' to control the activation of another valve (not shown) that could be used to control the direct injection or siphoning of an additive, such as soap or wax, into the flow of fluid under certain conditions. For example, the third cam could include a cam lobe (not shown) that was configured to open when the first and second drums 200 and 202 are positioned in the second setting.

While specific examples have been described in the specification and illustrated in the drawings, it will be understood by those of ordinary skill in the art that various changes may be made and equivalents may be substituted for elements thereof without departing from the scope of the present disclosure as defined in the claims. Furthermore, the mixing and matching of features, elements and/or functions between various examples is expressly contemplated herein so that one of ordinary skill in the art would appreciate from this disclosure that features, elements and/or functions of one example may be incorporated into another example as appropriate, unless described otherwise, above. Moreover, many modifications may be made to adapt a particular situation or material to the teachings of the present disclosure without departing from the essential scope thereof. Therefore, it is intended that the present disclosure not be limited to the particular examples illustrated by the drawings and described in the specification as the best mode presently contemplated for carrying out the teachings of the present disclosure, but that the scope of the present disclosure will include any embodiments falling within the foregoing description and the appended claims.

What is claimed is:

1. A pressure washer wand comprising:

a housing having a pistol-grip handle and a trigger guard;

a valve assembly housed in the housing, the valve assembly including a first valve and a second valve, each of the first and second valves including a valve member that is movable between a closed position and an open position, each valve member being biased toward the closed position;

a first outlet in fluid communication with the first valve;

a second outlet in fluid communication with the second valve; and a trigger coupled to the housing between the pistol grip handle and the trigger guard and movable between a first position and a second position, the trigger having a first cam and a second cam, the first and second cams being configured to move the valve members of the first and second valves, respectfully;

wherein moving the trigger from the first position to a first intermediate position between the first and second positions opens a first fluid communication pathway from the first valve to the first outlet, positioning the trigger in a second intermediate position between the first intermediate position and the second position opens a second fluid communication pathway from the second valve to the second outlet such that both the first and second fluid communication pathways are opened, and positioning the trigger in the second position closes the first communication pathway from the first valve to the first outlet while maintaining the second fluid communication pathway from the second valve to the second outlet open.

2. The pressure washer wand of claim 1, wherein the first cam is fixedly coupled to the trigger.

3. The pressure washer wand of claim 2, wherein the second cam is fixedly coupled to the trigger.

4. The pressure washer wand of claim 1, wherein at least one of the first and second cams is adjustably coupled to the trigger.

5. The pressure washer wand of claim 4, wherein the first cam is formed on a first drum that is rotatably coupled to a first side of the trigger.

6. The pressure washer wand of claim 5, wherein the second cam is formed on a second drum that is rotatably coupled to a second side of the trigger opposite the first side.

7. The pressure washer wand of claim 6, wherein the first and second drums are movable into an auxiliary position in which only the first valve is opened when the trigger is moved from the first position to the second position.

8. The pressure washer wand of claim 1, wherein the first and second valves are housed in a common valve body.

9. The pressure washer wand of claim 8, wherein a first conduit couples the first outlet to the first valve and a second conduit couples the second outlet to the second valve.

10. The pressure washer wand of claim 9, wherein the first and second conduits are discrete structures that are disposed along parallel axes.

11. The pressure washer wand of claim 1, further comprising a first nozzle in fluid communication with the first outlet and a second nozzle in fluid communication with the second outlet, the first nozzle including a nozzle outlet diameter larger than a nozzle outlet diameter of the second nozzle such that fluid flowing through the first nozzle generates less back-pressure than when flowing through the second nozzle;

wherein the first and second nozzle outlet diameters are configured so as to minimize recoil of the pressure washer wand when the trigger is moved from the first position to the first and second intermediate positions, and to the second position.

12. A pressure washer system comprising:

a pump having an outlet;

a hose having a first end, which is coupled in fluid communication to the outlet, and a second end; and a pressure washer wand having a housing, a valve, a first outlet, a second outlet and a trigger, the housing having a pistol-grip handle and a trigger guard, the valve assembly being housed in the housing and including a first valve and a second valve, each of the first and second valves including a valve member that is movable between a closed position and an open position, each valve member being biased toward the closed position, the first outlet being in fluid communication with the first valve, the second outlet being in fluid communication with the second valve, the trigger being coupled to the housing between the pistol grip handle and the trigger guard, the trigger being movable between a first position and a second position and having a first cam and a second cam, the first and second cams being configured to move the valve members of the first and second valves, respectfully;

wherein moving the trigger from the first position to a first intermediate position between the first and second positions opens a first fluid communication pathway from the first valve to the first outlet, positioning the trigger in a second intermediate position between the first intermediate position and the second position opens a second fluid communication pathway from the second valve to the second outlet such that both the first and second fluid communication pathways are opened, and positioning the trigger in the second position closes the first communication pathway from the first valve to the first outlet while maintaining the second fluid communication pathway from the second valve to the second outlet open.

13. The pressure washer system of claim 12, wherein the first cam is fixedly coupled to the trigger.

14. The pressure washer system of claim 13, wherein the second cam is fixedly coupled to the trigger.

15. The pressure washer system of claim 12, wherein at least one of the first and second cams is adjustably coupled to the trigger.

16. The pressure washer system of claim 15, wherein the first cam is formed on a first drum that is rotatably coupled to a first side of the trigger.

17. The pressure washer system of claim 16, wherein the second cam is formed on a second drum that is rotatably coupled to a second side of the trigger opposite the first side.

18. The pressure washer system of claim 17, wherein the first and second drums are movable into an auxiliary position in which only the first valve is opened when the trigger is moved from the first position to the second position.

19. The pressure washer system of claim 12, wherein the first and second valves are housed in a common valve body.

20. The pressure washer system of claim 19, wherein a first conduit couples the first outlet to the first valve and a second conduit couples the second outlet to the second valve.

21. The pressure washer system of claim 20, wherein the first and second conduits are discrete structures that are disposed along parallel axes.

22. The pressure washer system of claim 12, further comprising a first nozzle in fluid communication with the first outlet and a second nozzle in fluid communication with the second outlet, the first nozzle including a nozzle outlet diameter larger than a nozzle outlet diameter of the second nozzle such that fluid flowing through the first nozzle generates less backpressure than when flowing through the second nozzle;

wherein the first and second nozzle outlet diameters are configured so as to minimize recoil of the pressure washer wand when the trigger is moved from the first position to the first and second intermediate positions, and to the second position.

* * * * *

UNITED STATES PATENT AND TRADEMARK OFFICE

CERTIFICATE OF CORRECTION

PATENT NO. : 7,661,609 B2
APPLICATION NO. : 11/518602
DATED : February 16, 2010
INVENTOR(S) : Shane Dexter et al.

It is certified that error appears in the above-identified patent and that said Letters Patent is hereby corrected as shown below:

Column 7,
Line 46, "respectfully" should be -- respectively --.

Column 8,
Line 51, "respectfully" should be -- respectively --.

Signed and Sealed this

Twenty-fifth Day of May, 2010

David J. Kappos

David J. Kappos
*Director of the United States Patent and Trademark Office*